US006915935B2

(12) United States Patent
Portnoy

(10) Patent No.: US 6,915,935 B2
(45) Date of Patent: Jul. 12, 2005

(54) SHEET DISPENSING SYSTEM FOR ROLLED MATERIALS

(76) Inventor: Arkady Portnoy, 23401 Schoolcraft St., West Hills, CA (US) 91307

( * ) Notice: Subject to any disclaimer, the term of this patent is extended or adjusted under 35 U.S.C. 154(b) by 54 days.

(21) Appl. No.: 10/612,773

(22) Filed: Jul. 1, 2003

(65) Prior Publication Data

US 2004/0031837 A1 Feb. 19, 2004

Related U.S. Application Data

(60) Provisional application No. 60/393,955, filed on Jul. 2, 2002, and provisional application No. 60/410,179, filed on Sep. 11, 2002.

(51) Int. Cl.[7] ..... B26F 3/02

(52) U.S. Cl. ..... 225/38; 83/650; 225/43; 242/594.1

(58) Field of Search ..... 225/38, 39.4, 41, 225/43; D7/609; 83/649, 650; D6/514, 518, 520, 522, 523; 220/213, 345, 345.2, 345.4, 350, 351; 242/594.1; 74/608, 609; 409/134; 312/34.1, 34.8, 34.19, 34.21

(56) References Cited

U.S. PATENT DOCUMENTS

| | | | | | |
|---|---|---|---|---|---|
| 851,835 | A | * | 4/1907 | Ramsey | 225/42 |
| 1,261,668 | A | | 4/1918 | Winterhalter et al. | |
| 1,299,087 | A | | 4/1919 | Winterhalter et al. | |
| 2,959,317 | A | * | 11/1960 | Aldridge | 220/4.01 |
| 2,969,169 | A | * | 1/1961 | Botnick | 225/43 |
| 3,028,060 | A | * | 4/1962 | Haley | 225/53 |
| 4,934,575 | A | | 6/1990 | Mustafa | |
| 5,305,937 | A | | 4/1994 | Barnett | |
| 6,749,097 | B1 | * | 6/2004 | McElhinny | 225/20 |
| 2003/0019971 | A1 | * | 1/2003 | Lewis et al. | 242/564.4 |

* cited by examiner

*Primary Examiner*—Allan N. Shoap
*Assistant Examiner*—Carolyn Blake
(74) *Attorney, Agent, or Firm*—Michael Blaine Brooks, P.C.; Michael B. Brooks; Andrew S. Naglestad

(57) ABSTRACT

A dispensing system including a plurality of covered dispensers and an uncovered dispenser for readily dispensing sheet materials in a rapid and safe fashion. Each covered dispenser includes: a tray surface, arcuate in cross-section, for receiving a roll of sheet material; a cutting surface fixedly attached to a front edge of the tray; a counterweighted cover, having a front edge and a back edge, with an offset pivot point above the principal rotational axis of the tray; the counterweight being integral to the back edge of the cover; and a blade guard fixedly attached to the cover on a side opposite the counterweight. Each uncovered dispenser includes: a dowel support; and a dowel, whereby a roll of sheet material is mountable.

6 Claims, 14 Drawing Sheets

SHEET DISPENSING SYSTEM FOR ROLLED MATERIALS

CROSS-REFERENCE TO RELATED APPLICATION

This application claims the benefit of Provisional Patent Application Ser. No. 60/393,955 filed Jul. 2, 2002, titled SHEET DISPENSING SYSTEM FOR ROLLED MATERIALS, by Arkady Portnoy, and Provisional Patent Application Ser. No. 60/410,179, filed Sep. 11, 2002, titled SHEET DISPENSING SYSTEM FOR ROILED MATERIALS, by Arkady Portnoy, both of which are hereby incorporated in their entirety herein by reference.

BACKGROUND

1. Field of the Invention

This invention relates to sheet material dispensers and more particularly to dispensers for dispensing sheet materials provided on a roll.

2. State of the Art

Presently, household wrapping papers, plastics and foils are commonly wound about rolls and in several cases are stored in rectangular or parallelepiped-shaped boxes. A common procedure for extraction and severance involves holding the storing box in one hand while pulling to unwind the sheet, followed by a shearing motion to pull the extracted material across a cutting surface, a cutting surface often integral to the storing box. For wrapping paper not stored in a box, an auxiliary cutting surface or device is used, particularly where perforations in the material are not present. Injuries and inconveniences result from the presently practiced methods and devices for dispensing rolled materials.

SUMMARY

Disclosed is a dispensing system for the dispensing sheet materials provided on a roll, the rolls of which may be loaded and dispensed from an individual dispenser of the dispensing system. In a household embodiment, the sheet materials are household materials including, but not limited to, plastic wrap, aluminum foil and paper towel. The household embodiment is readily installable by being hung on or otherwise attached to a vertical surfaces such as a wall, kitchen cabinet or refrigerator. The three dispensers-in-one dispensing system embodiment of the present invention is comprised of two substantially identical dispenser assemblies for wrap and foil and a dispenser assembly principally comprised of an axel for the roll of paper towel. The dispensers and dispensing system allow for simple and safe loading of rolled materials as well as convenient and safe extracting and dispensing of the material of selected length. Safety and ease of use are features of the dispensers and dispensing system.

The preferred embodiment of the present invention is a vertically-oriented, preferably wall-mounted, household dispensing system for rolled materials such as plastic wraps, aluminum foil and paper towel. A plurality of dispensers is preferably combined in one frame or structure and thereby provides a safe and easy means of loading and dispensing rolled materials.

In one embodiment, the dispenser for wrap or foil is an assembly comprised of two major parts: a lower compartment and a multifunctional cover. A dispensing system is comprised of one or more of the dispensers similarly oriented and separately or in combination includes pairs oriented in opposition.

In the example embodiment, the lower compartment preferably accommodates up to a full standard roll of a material for dispensing. The roll freely rests at the bottom of the arcuate bed (e.g., a tray of a substantially half-cylinder shape in cross-section) of the lower compartment. In the preferred use, the roll is placed into the compartment with the bottom of the roll resting in the arcuate tray and with the roll oriented so that it unwinds so the sheet is drawn over the top of the roll outwardly to the cutting surface. In this position further unwinding, i.e., topside unfurling, of the roll pushes the roll in the direction of the back of the compartment formed by the tray and the rotatable cover and thereby prevents the roll from being pulled out from the compartment and, at the same time, allows for ease of extraction of the materials of required length.

A cutting edge is preferably situated along the length of each rolled material to be cut. A serrated cutting blade is attached to the front edge of the shelf of the lower compartment in the preferred embodiment of the present invention. The cutting blade preferably runs along the length of the front shelf edge and is preferably raised above the shelf level by a relative distance of approximately ⅛ of an inch (0.3 cm) with a preferred range of 1/16 to 3/16 of an inch (0.15 to 0.45 cm). Two apertures on the sides of the shelf allow the user to easily and safely grasp the material in order to extract the necessary length.

The lower compartment is fixedly attached to the frame and oriented in a fashion so that the flat shelf portion of the lower compartment extends beyond the plane formed by the frame boundaries with slots on opposing transverse sides of the extending portion of the lower compartment. Accordingly, this embodiment allows for easy access by the fingers of a user by way of the slots on the sides of the shelf and this easy access aids in the convenient extraction of the material.

The multifunctional cover provides safety functions by protecting the hands of a user from the cutting edges and restrains the material from movement during severing action. The cover introduces a segment of a tube with radial sides and is mounted inside the frame. The arcuate sides are cut short of reaching the front padded edge of the cover. This embodiment allows unrestricted contact of the front edge with the shelf of the lower compartment, which is necessary for a sufficiently securing grasp of the material at the time of the material severing.

In some embodiments, the cover is provided with a counterweight located under the rear edge of the cover. The counterweight is fixedly attached or integral to the surface of the cover where such integration includes embodiments such as thicker cross-sections in the aft portions of the cover. When the cover is open for any reason, the counterweight prevents the cover from closing by compensating the weight of the safety extension of the cover. Preferably, the counterweight provides cover balance. This structure, together with the counterweight, ensures that the center of gravity of the cover falls behind the vertical axis of pivotal connection of the cover when the cover is open.

In the preferred embodiment of the present invention, the front edge of the cover is enveloped in a rubber pad that is extended along the entire edge. The purpose of pad is chiefly to provide a strong frictional grip of the material and thereby restrain it from moving at the time of the severance. Above the top line of the rubber pad is a safety extension of the cover. In terms of the closing direction of the cover, the safety extension extends ahead of and downward from the outer portion of the leading edge of the cover and preferably thereby completely covers, i.e., overlaps, the entire length of the serrated blade when the cover is closed. This embodiment prevents the user from contact with the sharp serrated blade especially at the time of severance of the material.

The multifunctional cover is pivotally connected to the frame in the way it rotates inside the frame. The location of the pivots meets three conditions: (1) when the cover is rotated to an open position, there is enough space between the lower edge of the safety cover and the shelf of the lower compartment for unrestricted loading of the rolled material; when the cover is rotated to the open position, the gravity center of the cover falls behind the vertical axes of the pivot; and (3) when cover is rotated to closed position the front edge of the cover with the rubber pad comes down parallel to the shelf of the lower compartment and lands in the middle of the shelf strip between the slots and the serrated blade.

A paper towel dispenser, in some embodiments, is integrated as an uncovered dispensing assembly, and is preferably located in the lower area of the vertically mounted frame embodiments. This particular dispensing assembly uses a dowel acting as an axel of a diameter less than the standard commercial tube around which the paper is rolled. That is, typical paper towel rolls can be found having 5 to 6 inches (12.1 to 14.5 cm) in diameter of material rolled around the core with internal core being diameter 1.5 inches (3.6 cm).

Accordingly, the fixture introduces an axel 1¼ inches (3.0 cm) in diameter. In order to afford ease of axel removal for roll replacement while securing the roll for downward dispensing, end portions of the axel preferably project as parallelepipeds insertable into open ended slots of the frame. The slots on the sides of the frame are preferably aligned approximately 45 degrees from vertical in the direction of the dispensing rotation. In use, the user slides the paper towel roll onto the axel and inserts the axel projections into the slots. The 45 degrees slot provides an axel mount that resists axel from being pulled out from the slots in the frame at the time of downward dispensing of the paper towel.

In a second preferred embodiment, the single roll dispenser is a dispensing assembly comprising three main parts within a frame: (a) a lower compartment; (b) a rotating cover; and (c) a safety screen.

The lower compartment is shaped to have an arcuate section, for cradling a roll of dispensable material, where the lower compartment smoothly transforms into a flat area extending outwardly and flush with the outer edge or top edge or level of the frame. There are preferably two apertures on the sides of the flat area. The apertures are located in the top corners of the flat area and are adjacent to apertures in the frame. The function of the apertures is principally to allow the user easily and safely grasp the unrolled part of the material, preferably manually, i.e., digitally, in order to extract the necessary length of material.

The lower compartment is fixedly attached to the frame such that the lower compartment is entirely within the frame planar boundaries wherein the shelf coincides with the top surface of the frame. The shelf located between the two dispensers is wider than the one at the edge of the frame. While the invention has several objects, there are two objectives for such an embodiment: (1) to provide room for unrestricted closing of the rotating cover and convenient dispensing of the material; and (2) to install two apertures for easy lifting and relocating of the whole dispenser.

At the top of the radial part of the lower compartment and also adjacent to the frame there are two slots, wide enough to receive the radial sides of the rotating cover. In open position the sides of the rotating cover rest on the bottom sides of those slots, which act as stops. Such an embodiment allows the rotating cover to hide completely under the screen.

Each rotating cover is preferably the only moving part of the dispensing assembly. In the closed position, the front edge of the cover rests on the shelf of the lower compartment or tray and in a position for efficient and shrouded severing of extended sheet material. The front edge of the rotating cover is preferably equipped with a serrated blade, running along the whole edge. A leverage pin is attached in the middle of the top surface of the cover. At the time of severing the user holds the pin down, preventing the cover from opening and assuring the smooth severing. To open the cover the user rotates the cover by pulling the pin up. When the pin reaches the top edge of the safety screen it enters the slot in the safety screen. This embodiment provides unrestricted full opening of the lower compartment for loading or extracting of the material, as well as full hiding of the serrated blade behind the screen.

The pin protrudes ⅛ inch (0.3 cm) above the screen for easy recovery of the cover into closed position. The rotating cover is pivotally connected to the frame in the way it rotates inside the frame. The pivotal center of the cover is set off the center of the radial part of the lower compartment.

When the rotating cover is brought into the open position, the teeth of the serrated blade protrude and for safety reasons need to be covered to prevent the user from contacting the blade. The safety screen provides this protection. The safety screen introduces a radial segment fixedly attached to the frame such that when the cover is open it rotates to a position concentric and locally parallel to the screen and thereby the cutting surface, preferably a serrated blade, is substantially hidden under the screen. There is provided a slot curved in the screen in the direction of the cover rotating that is open at the top edge of the screen. The slot provides unrestricted movement of the pin attached to the cover at the time of opening or closing of the cover.

BRIEF DESCRIPTION OF THE DRAWINGS

For a more complete understanding of the present invention and for further features and advantages, reference is now made to the following description taken in conjunction with the accompanying drawings, in which.

DETAILED DESCRIPTION

Figure 1:
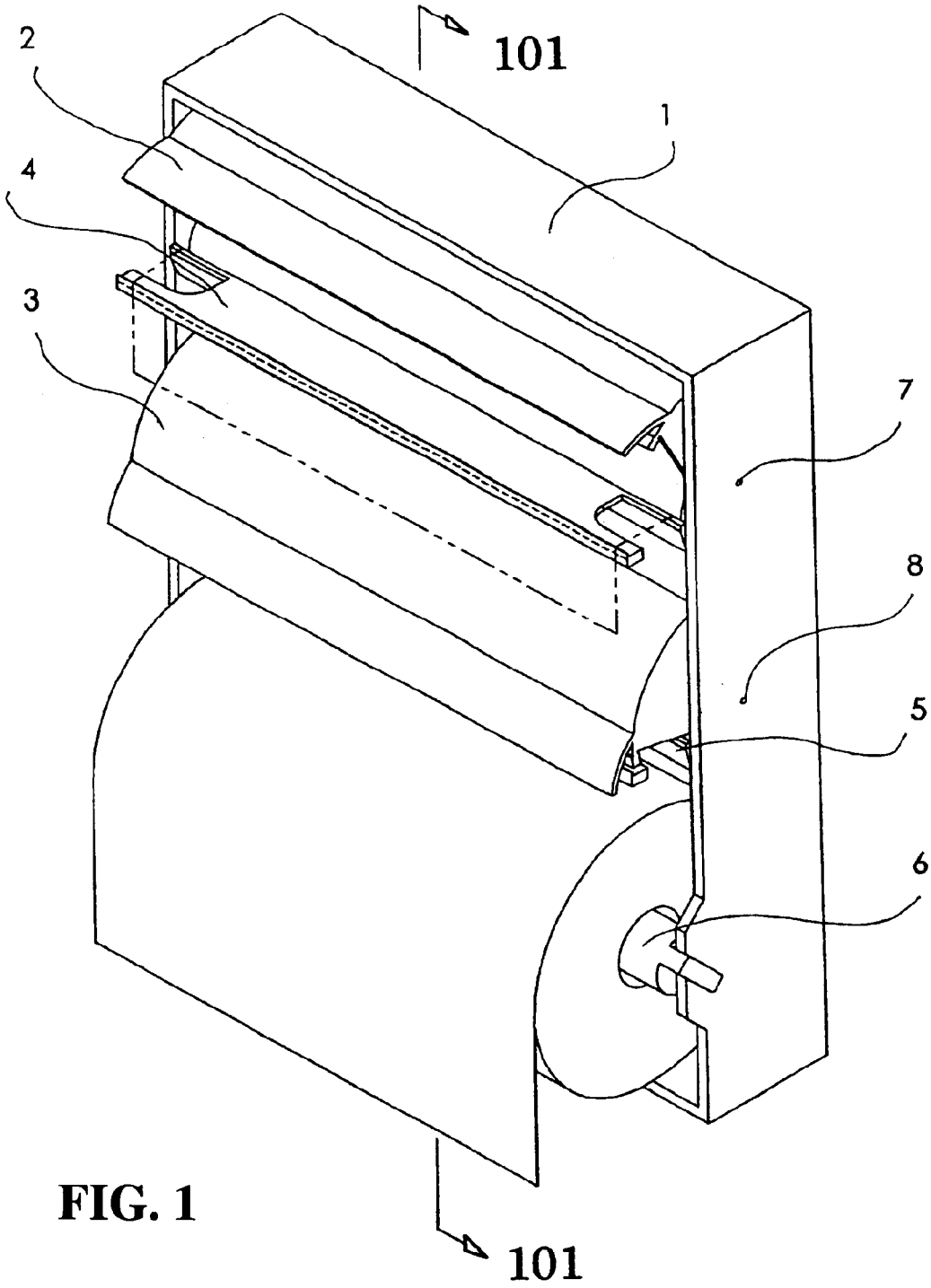
FIG. 1 is a perspective view of a vertically oriented dispensing system embodiment.

A perspective view of an example vertically mounted dispensing system of the present invention is illustrated in FIG. 1 showing the frame 1 preferably comprised of four panels and an optional back panel. A first dispensing assembly of the example dispensing system is illustrated with its cover 2 (e.g., shroud or blade guard) in the retracted, or sheet extracting, position. Also shown is the first lower portion 4 of the first dispensing assembly over which the rolled material is drawn and later severed by the cover when moved into the closed position. A second dispensing assembly of the example dispensing system is illustrated with its cover 3 in the closed, or cutting, position where the cover is in contact with the second lower portion 5. A third dispensing assembly of the example dispensing system is illustrated with a roll of material mounted on an insertable axel 6. The first cover pivotal point 7 and the second cover pivotal point 8 provide self-sustained retraction and adequate pressure to support severing of the material when closed.

Figure 2:
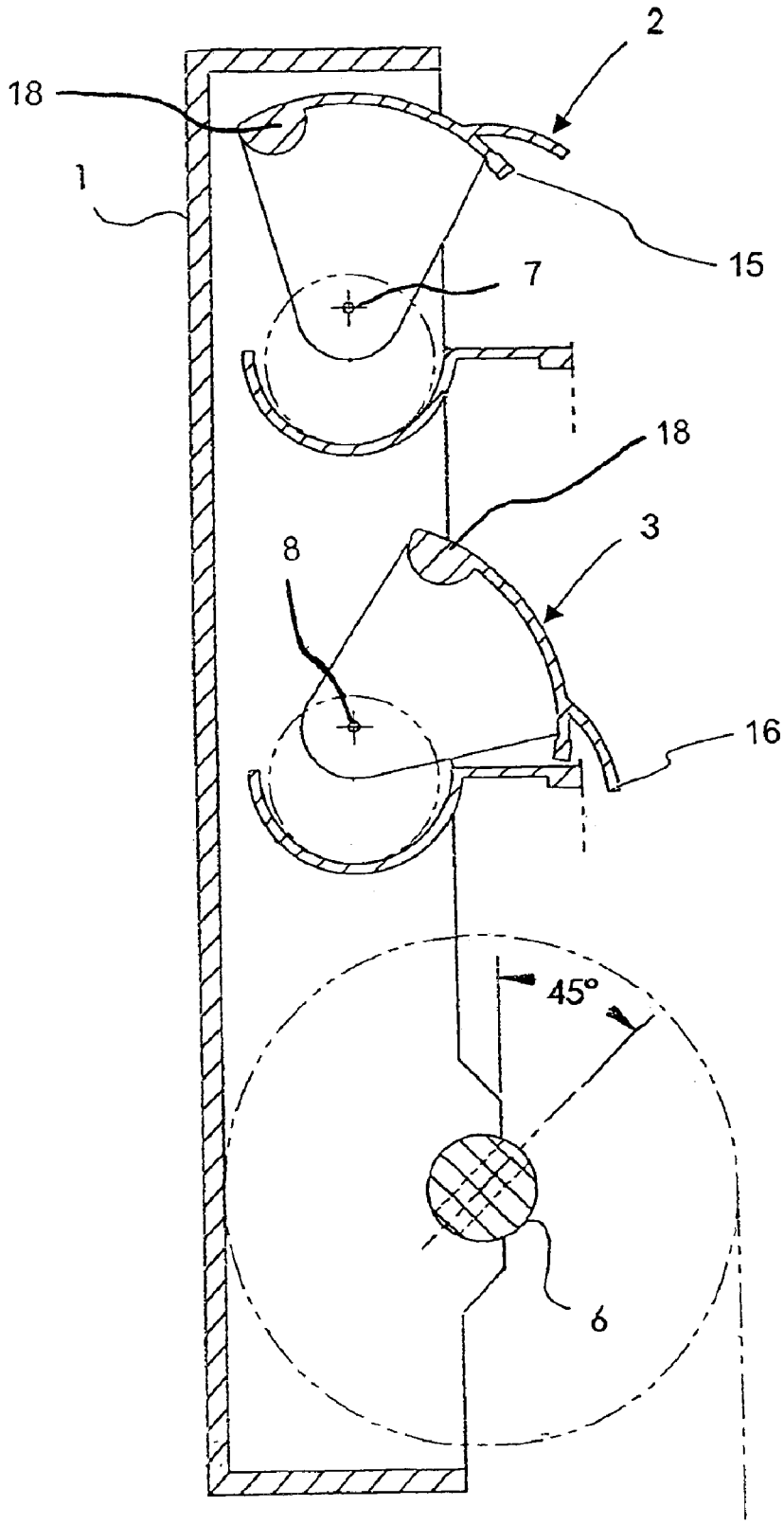
FIG. 2 is a longitude cross-sectional view of a vertically oriented dispensing system.

FIG. 2 illustrates a longitude cross-sectional view of a dispensing system along 101 of FIG. 1 where the first cover 2 shows its protective cover with its first lower portion 4 relative to its restrain strip 15, preferably a rubber-tipped edge, and the cover mass 18 on the edge opposite the cutting edge and aft of the first pivot point 7 used for a balanced and thereby stable open position. Also in this view, the second cover 3 is shown nearly in contact with the second lower portion 5 where the safety extension 16 shrouds the cutting region and the cover mass 18 forward of the second pivot point 8 adds to the stabilizing force to be applied along the cutting line. The axel 6 is shown in its orientation when inserted into the frame at the preferred 45 degrees from vertical in the direction of dispensing rotation.

Figure 3:
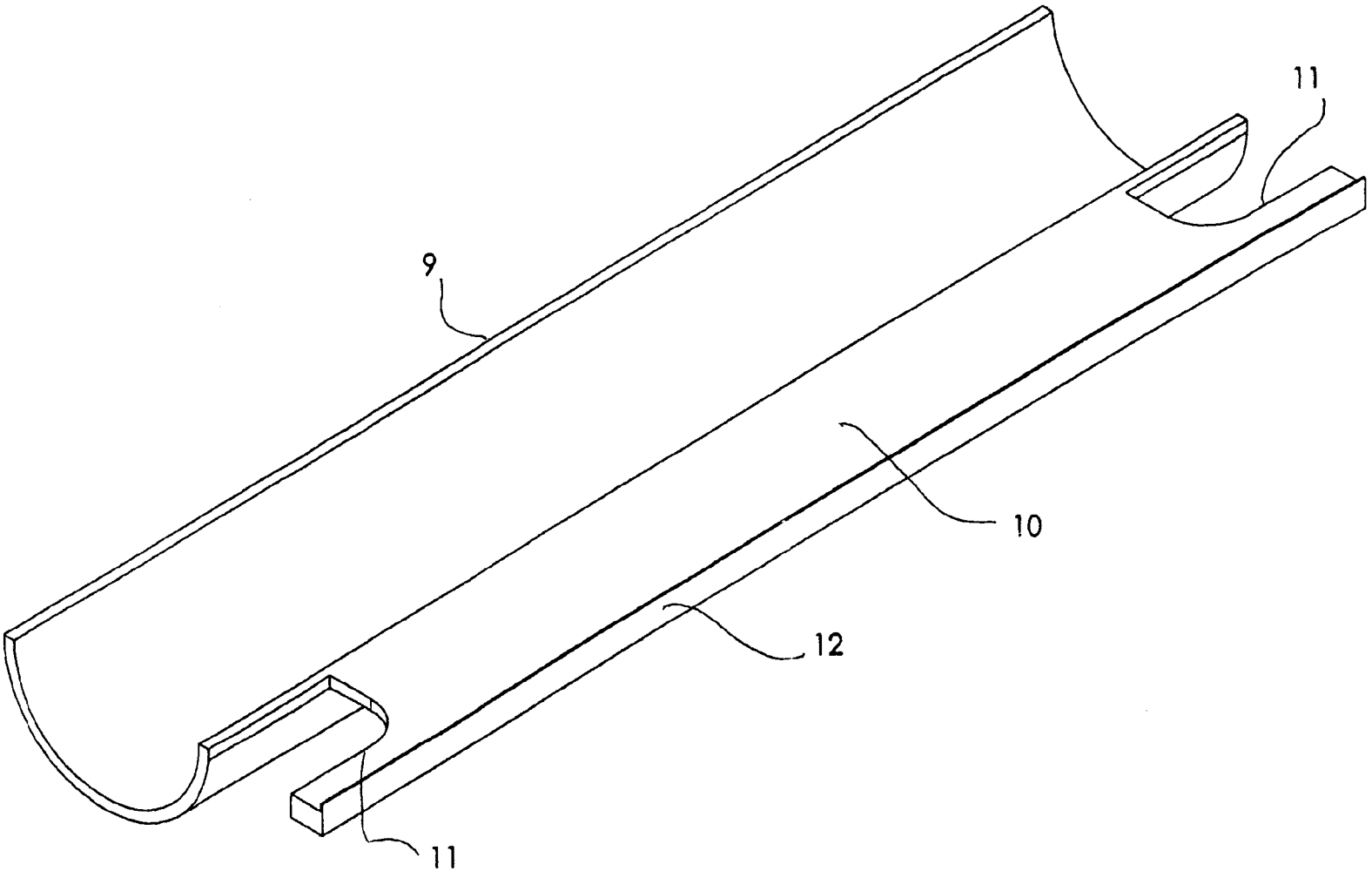
FIG. 3 illustrates in perspective view an example of a lower compartment of a vertically oriented dispenser assembly of the present invention.

FIG. 3 illustrates a lower compartment of the assembly of a dispensing system embodiment of the present invention comprised of a bed for the rolled material 9, a shelf of the lower compartment 10; apertures 11 of the shelf for the user to grasp the material, and in this example a cutting surface 12, like a serrated blade, extending upwardly from the shelf 10.

Figure 4:
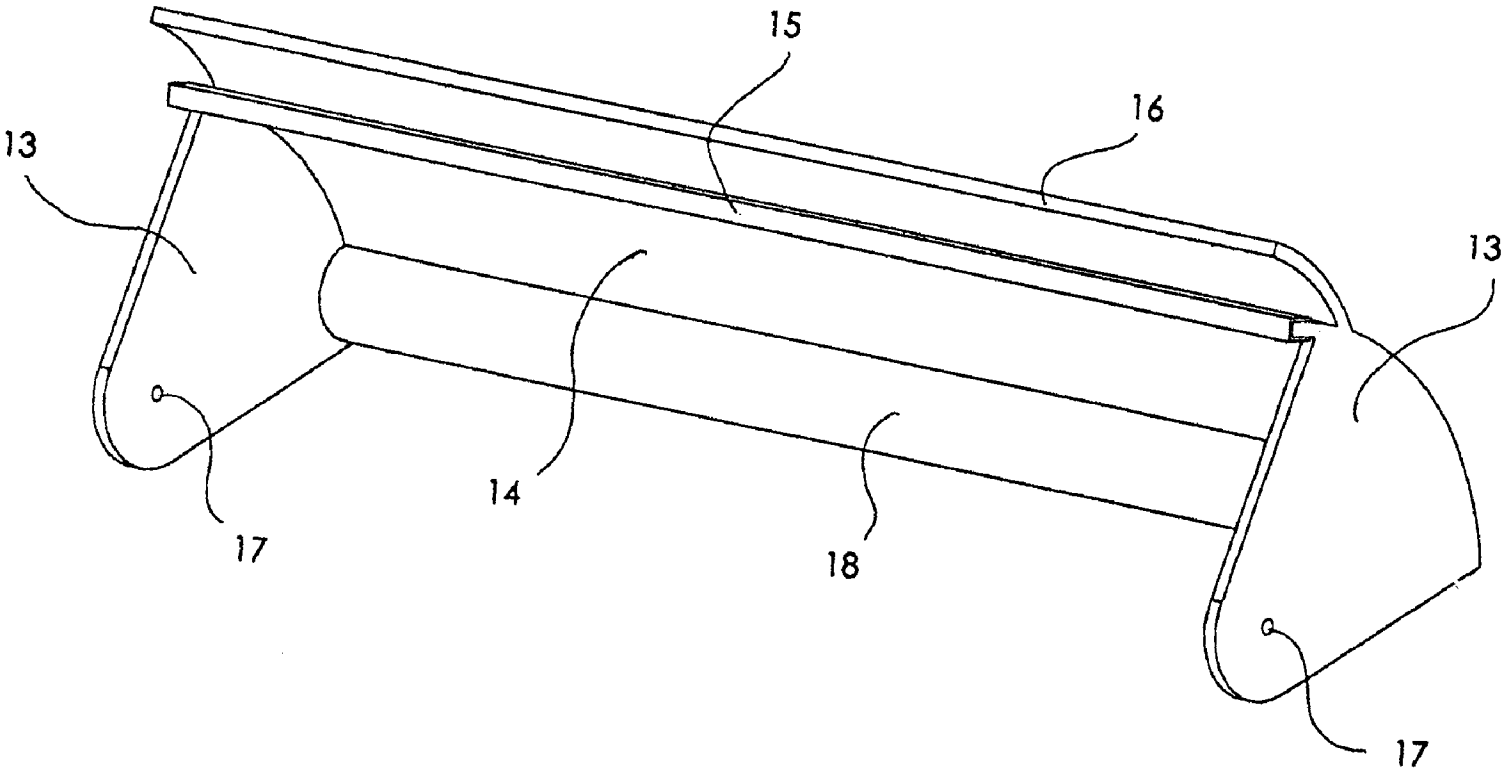
FIG. 4 illustrates in perspective view an example of a multifunctional cover of a vertically oriented dispenser assembly.

FIG. 4 illustrates a multifunctional cover portion comprised of approximately sector-shaped sides 13, example protective cover 14 with a rubber pad 15 at the front edge, a safety extension of the cover 16, counterweight 18 and a pivotal point 17 that aligns with the first pivot point 7 or second pivot point 8 of the example frame.

Figure 5:
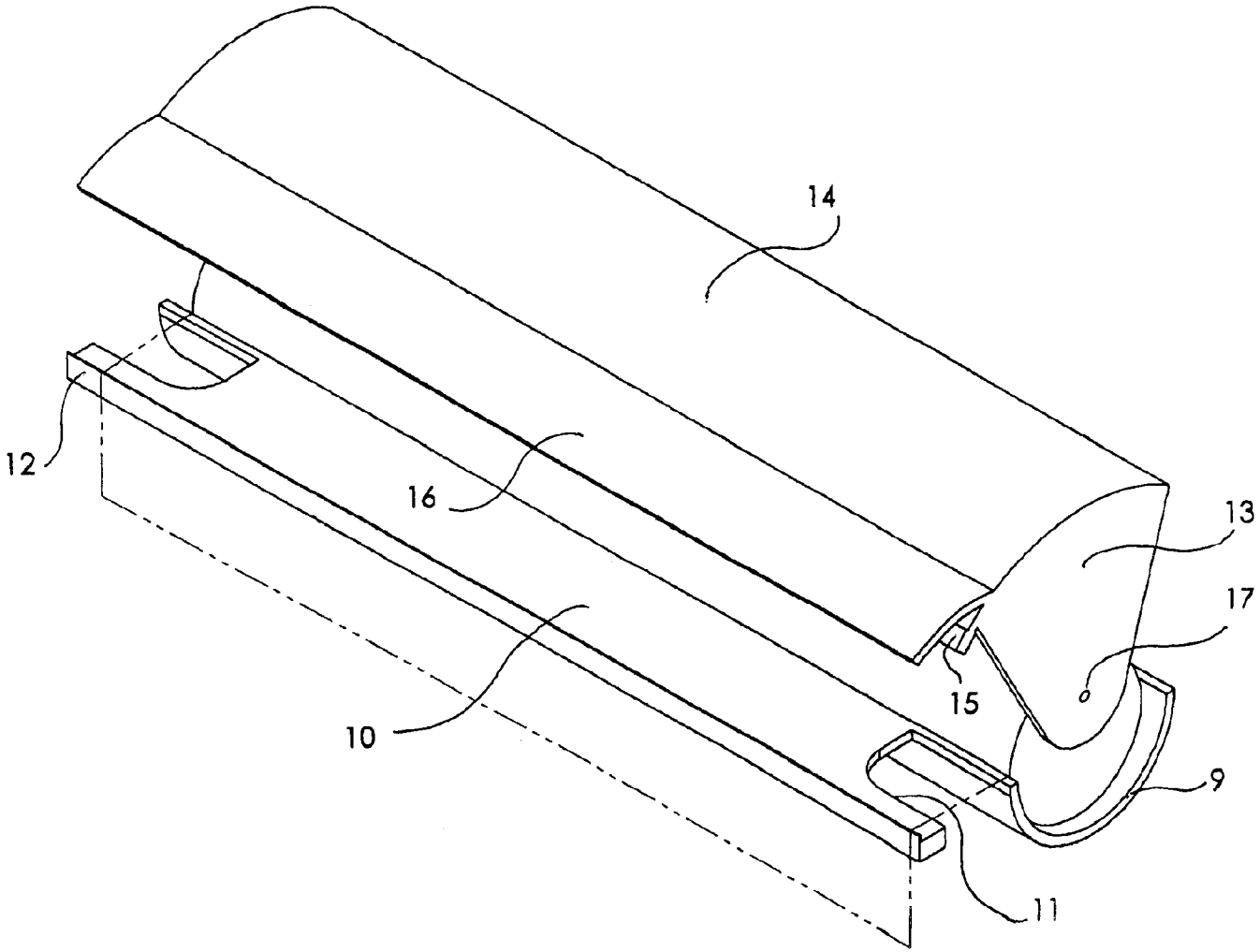
FIG. 5 is a perspective view of an example open vertically oriented dispenser assembly without a frame.

FIG. 5 is a view of an open dispensing assembly without a frame which illustrates a multifunctional cover portion in functional relation to a lower portion where the example cover portion is comprised of approximately sector-shaped sides 13, example protective cover 14 with a rubber pad 15 at the front edge, a safety extension of the cover 16, counterweight 18 and a pivotal point 17 that aligns with the first pivot point 7 or second pivot point 8 of the example frame. The example lower compartment of the assembly of a dispensing system embodiment of the present invention being comprised of a bed for the rolled material 9, a shelf of the lower compartment 10; apertures 11 of the shelf for the user to grasp the material, and in this example a edge or cutting surface 12, like a serrated blade, extending upwardly from the shelf 10.

Figure 6:
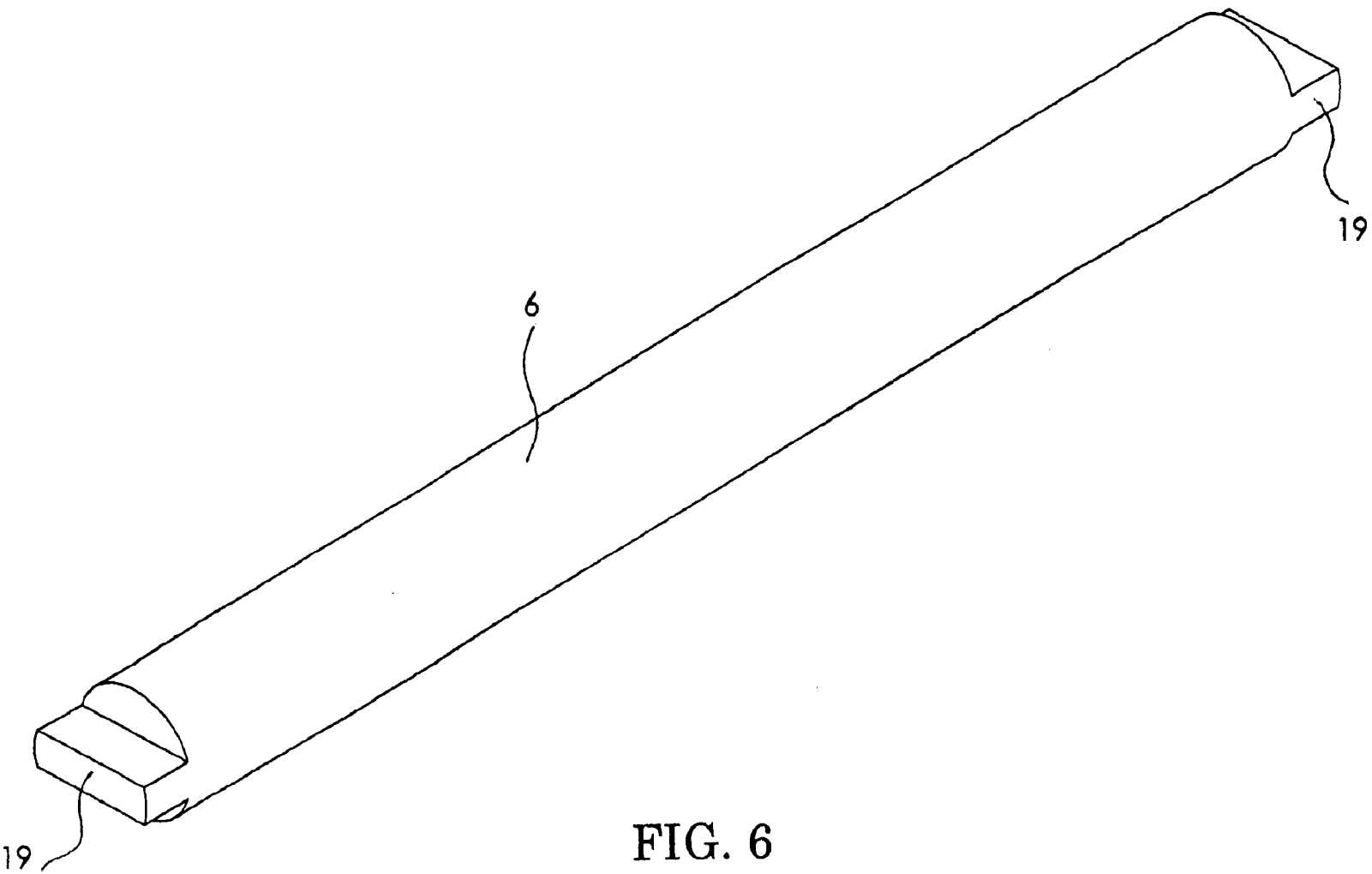
FIG. 6 illustrates an example axel for the paper towel dispenser fixture.

FIG. 6 is a perspective view of an axel for the paper towel fixture. The parallelepiped end portions 19 allow for the insertion of the axel into the frame of the dispensing system.

Horizontally-Oriented Embodiments

A second embodiment, a horizontally oriented embodiment of the present invention, is applicable, among other uses, in dispensing plastic wrap, aluminum foil suitable out of the kitchen cabinet drawer or the top of the kitchen counter. Typical kitchen drawer is approximately three to four inches (7.3 to 9.7 cm) deep and nine to fifteen inches (21.8 to 36.3 cm) wide. For the drawer mounted dispensing system embodiments, the drawer depth typically precludes paper towel dispensing with commercially available rolls and accordingly, the second embodiment example, it is preferred that the paper towel dispenser as described in the first embodiment is not included and leaving preferably one or two dispensing assemblies in a horizontal frame. The horizontal frame double or single dispenser is preferably used in any drawer with the width greater or equal to 9 inches (22.8 cm). Depending on the inside width of the drawer, the dispensing system is oriented so that the direction of dispensing is parallel or perpendicular to the front of the drawer.

Figure 7:
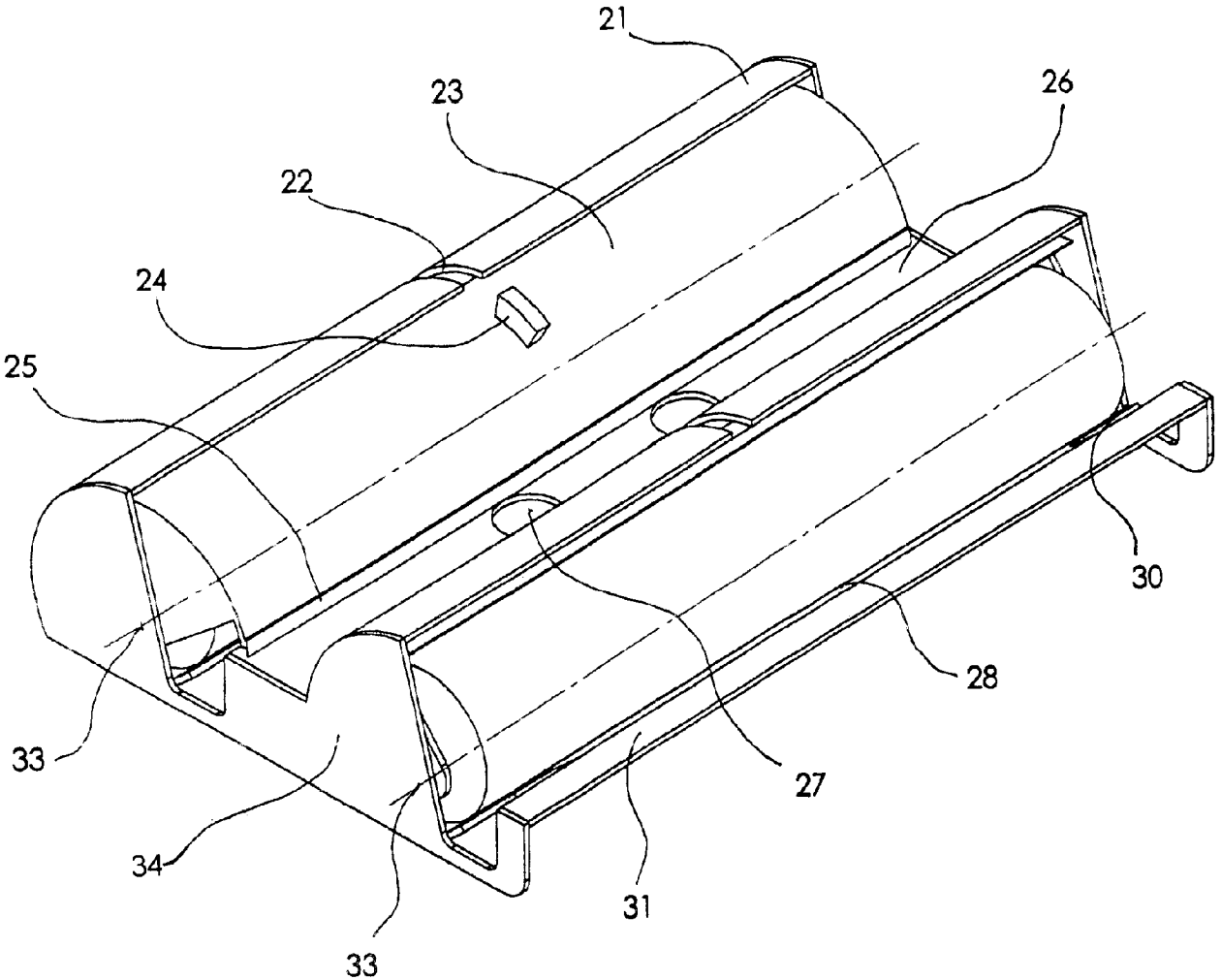
FIG. 7 is a side perspective view of the example alternative horizontally oriented dispensing system embodiment of the present invention.

FIG. 7 is a perspective view of a horizontal dispenser example of the present invention. Rotating covers 23 have an open position and a closed position. The rotating covers are provided with a leverage tab or pin 24 for easy retraction of the cover from open position and pushing down the cover at the time of severing. The rotating cover is equipped with a cutting surface 25 such as a serrated blade at the front edge of the cover. Rotating cover 23 is connected to the sidewalls 34 at the pivotal points 33. Safety screen 21 carries the protective function of shielding the cutting surface 25 and serves as a part of the frame. The function of the slot 22 in the screen is to accommodate the leverage pin 24 on the rotating cover at the time of the opening.

Lower compartments are comprised of a bed 28, horizontal shelves (e.g., and the first tray member 31 and the second tray member 26) and outer covers 21. A second shelve 26 is wider than first shelve 31 in order to accommodate two apertures 27 installed for lifting and relocating of the whole fixture. The first rotating cover 23 with the cutting edge 25 is shown in the closed, or cutting, position as it has been rotated forward about the first pivot point 33. The lower compartment in this embodiment allows for the gripping of the dispensed sheets from the side apertures 30 such as a side panel 34. The second rotating cover is shown open having been rotated aftward about rotating point 33.

Figure 8:
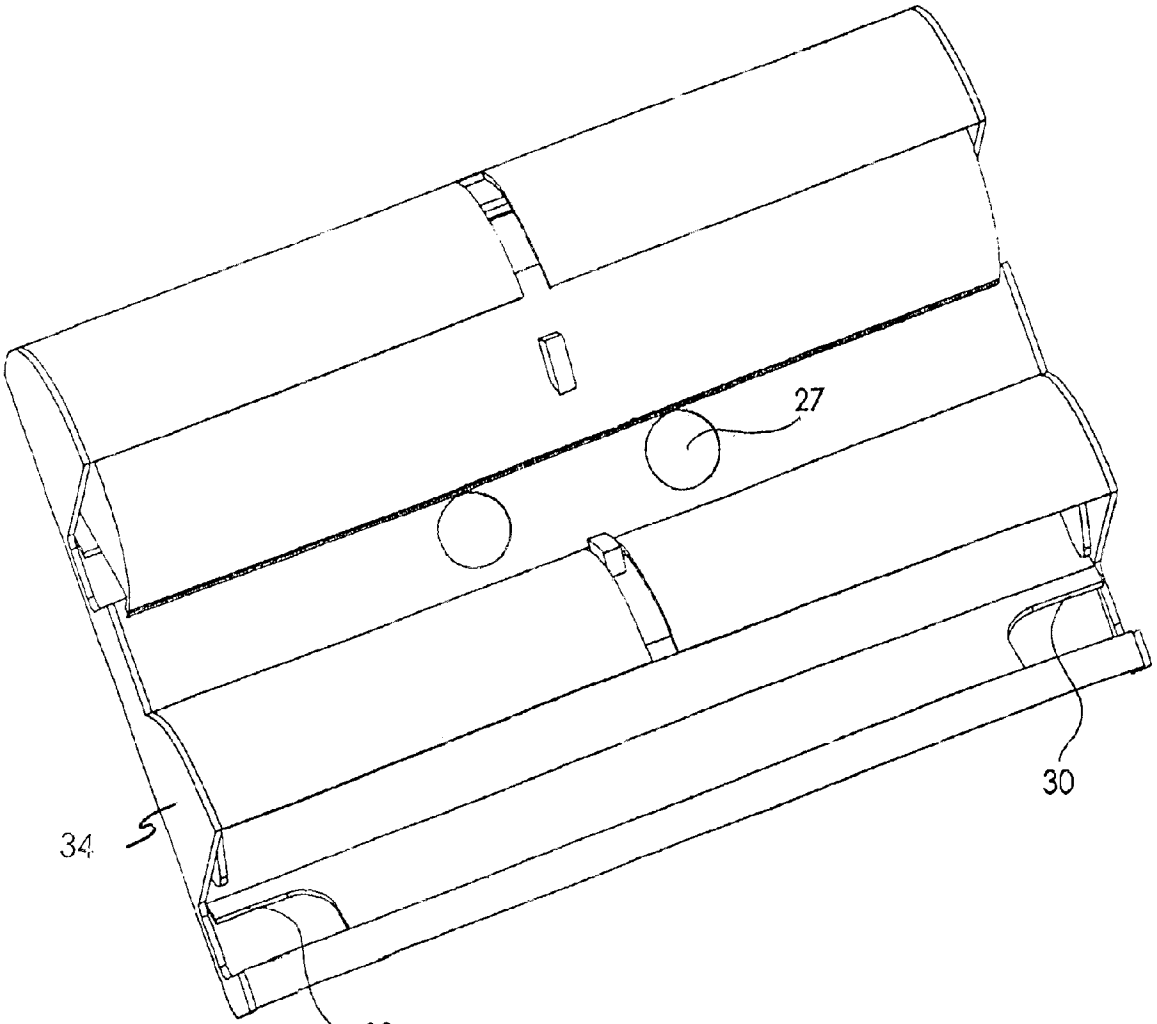
FIG. 8 is a top perspective view of the example alternative horizontally oriented dispensing system embodiment of the present invention.

FIG. 8 provides a top perspective view of this alternate embodiment showing the apertures for material griping 30 and the apertures for dispensing system lifting 27.

Figure 9:
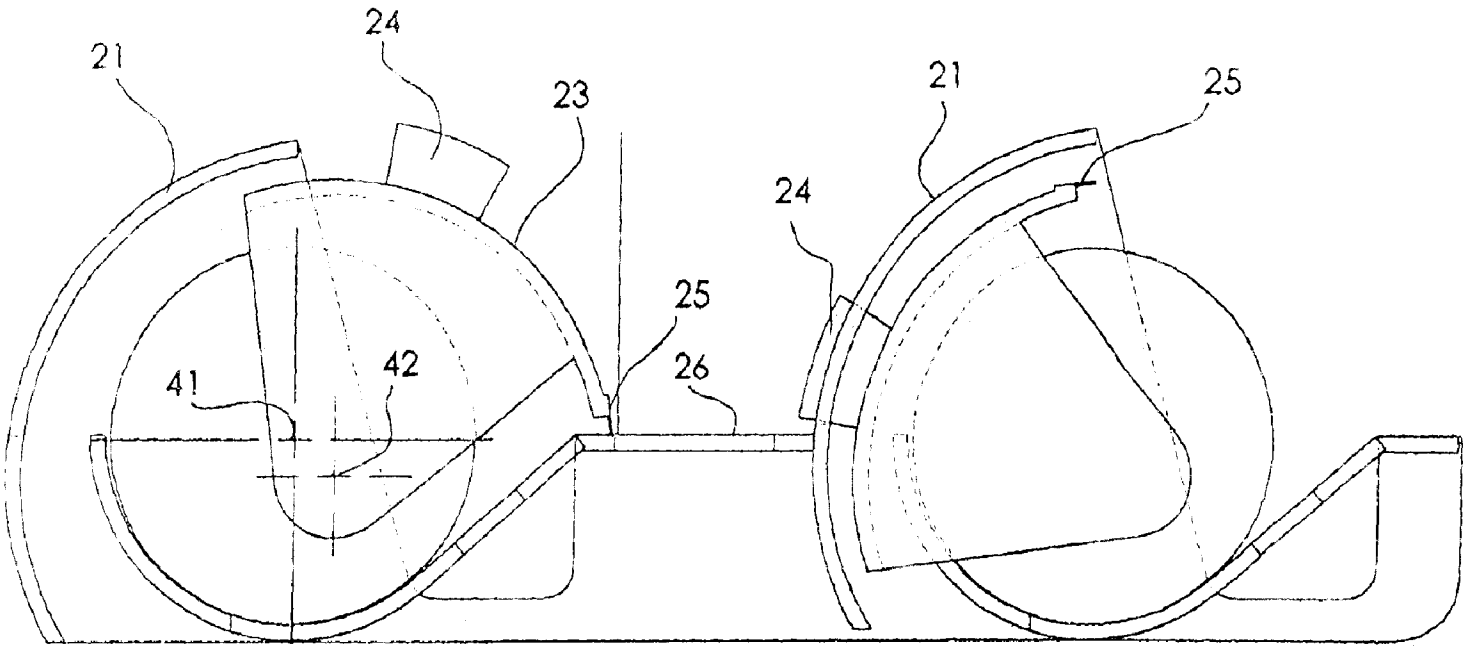
FIG. 9 is a side view of the example alternative horizontally oriented dispensing system embodiment of the present invention with a side panel removed.
Figure 10:
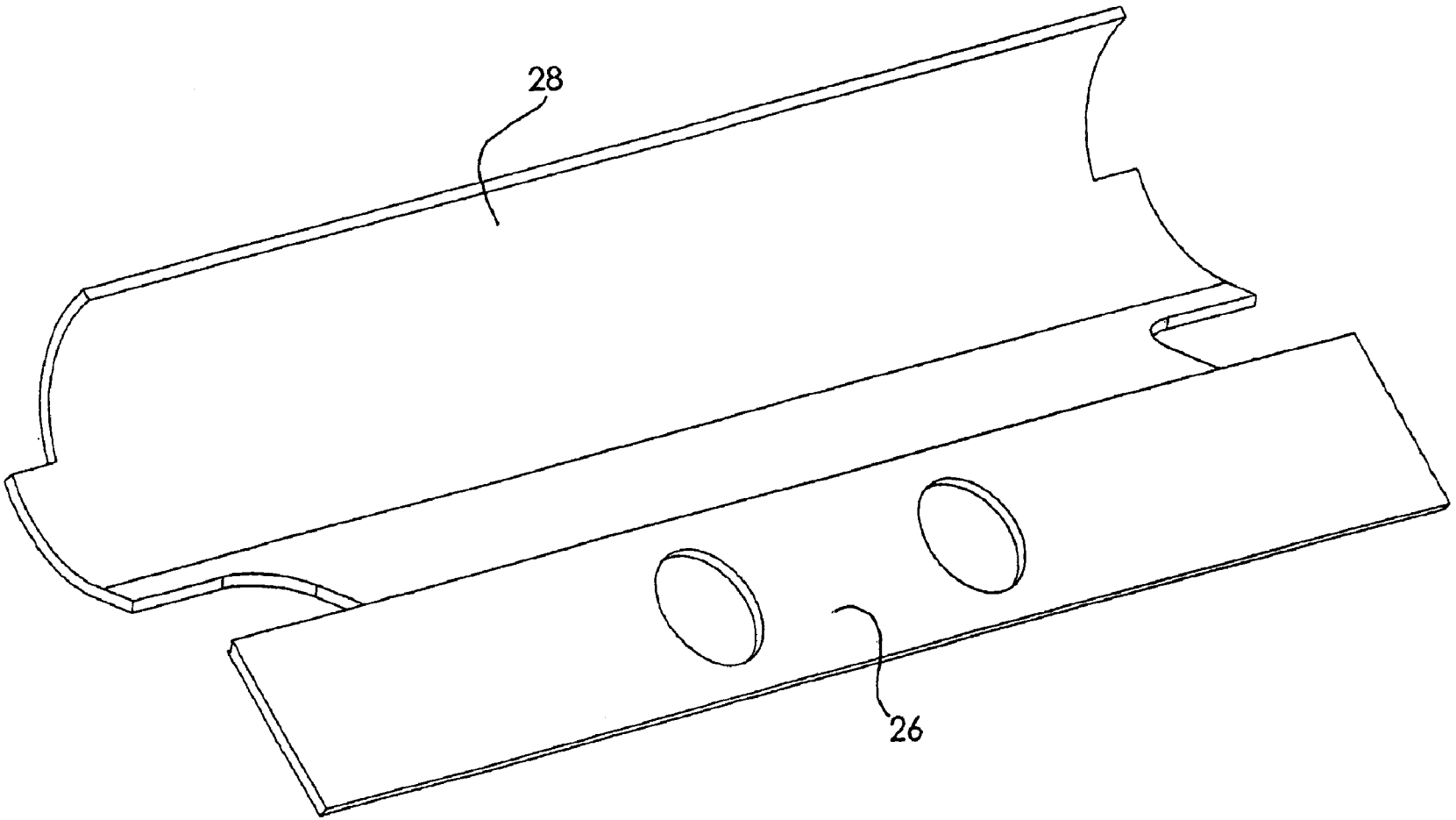
FIG. 10 is a perspective view of an aft or second tray member of the example alternative horizontally oriented dispensing system embodiment of the present invention.
Figure 11:
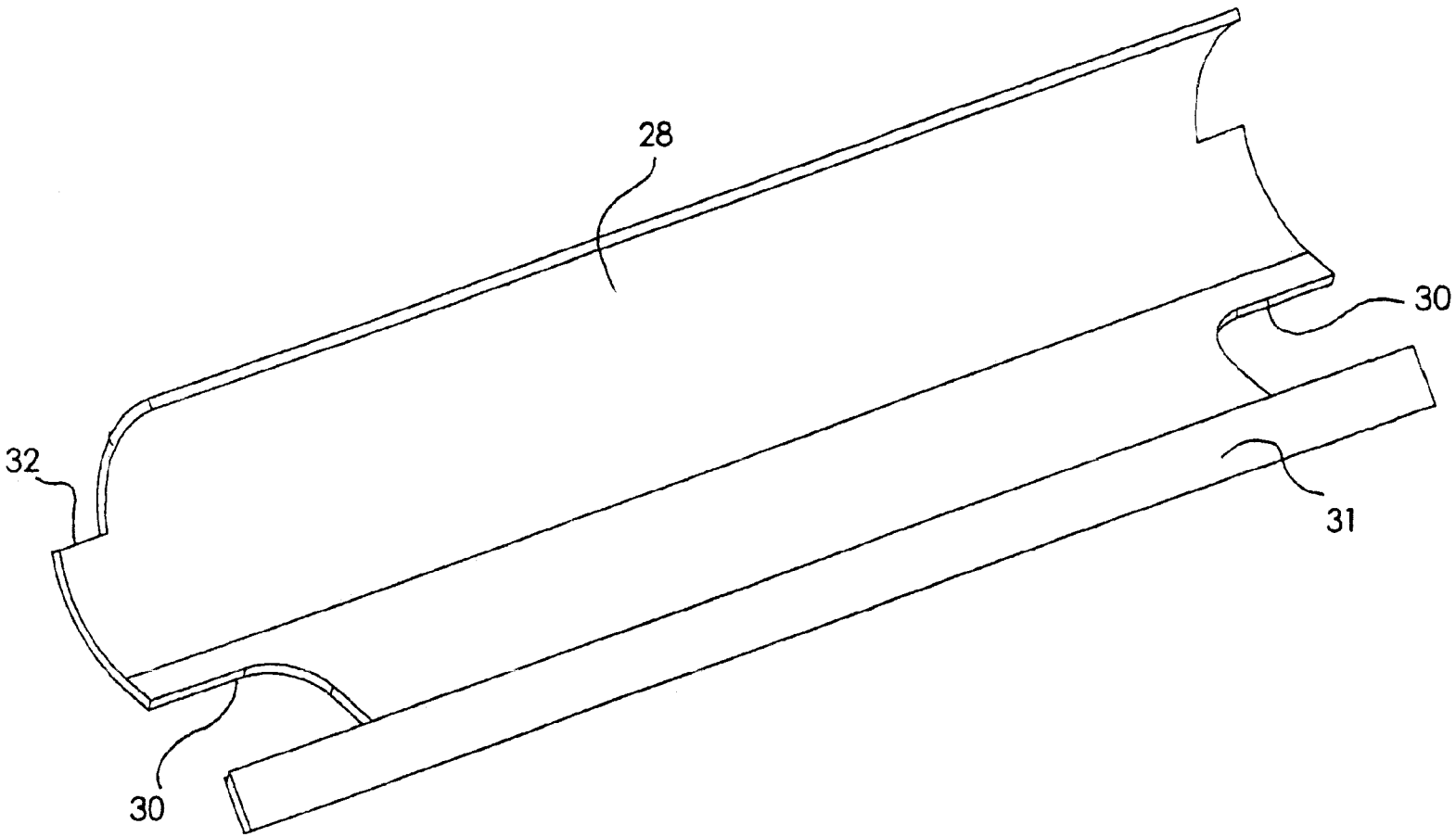
FIG. 11 is a perspective view of a first tray member of the example alternative horizontally oriented dispensing system embodiment.
Figure 12:
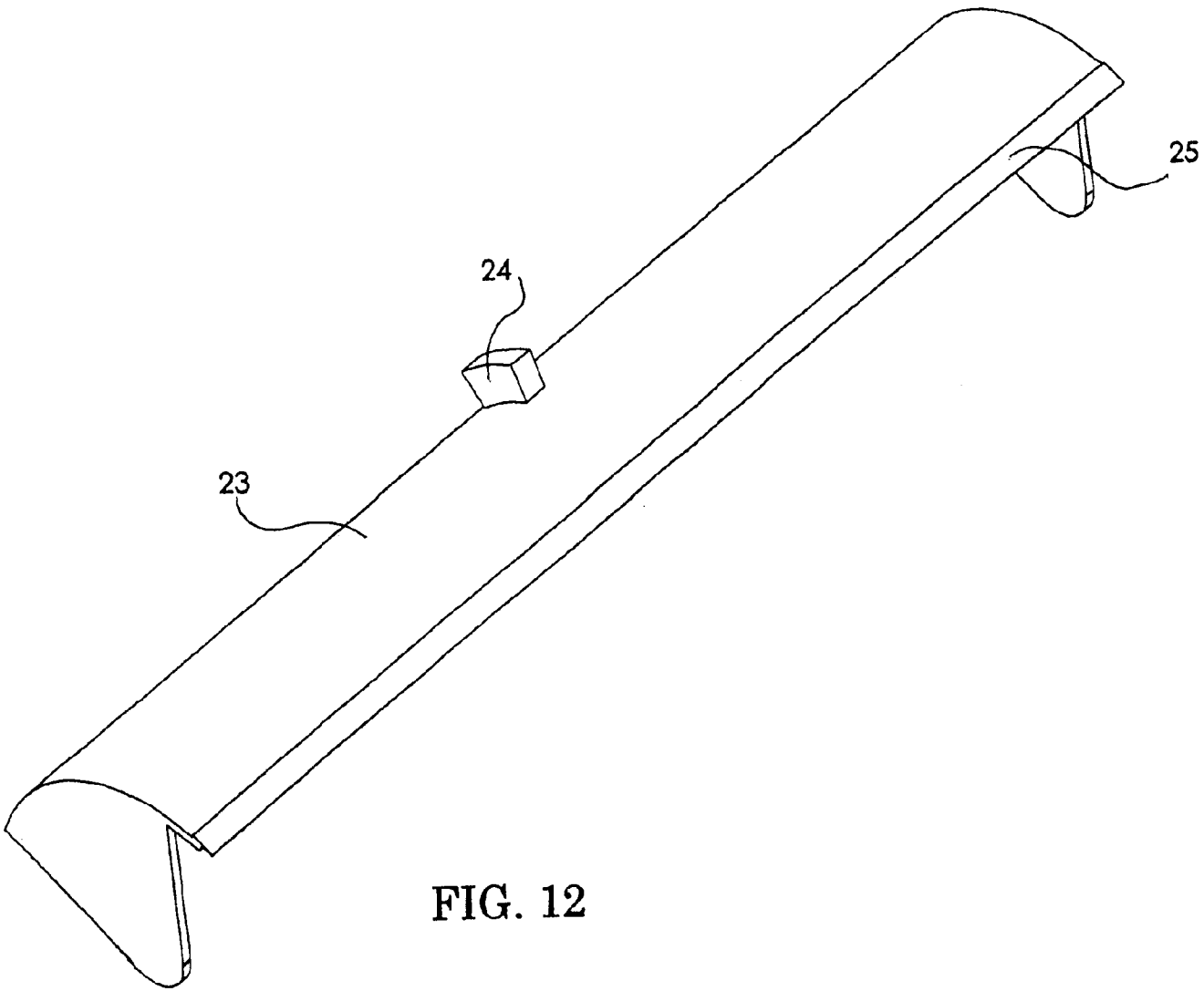
FIG. 12 is a perspective view of the cover member of the example alternative horizontally oriented dispensing system embodiment.
Figure 13:
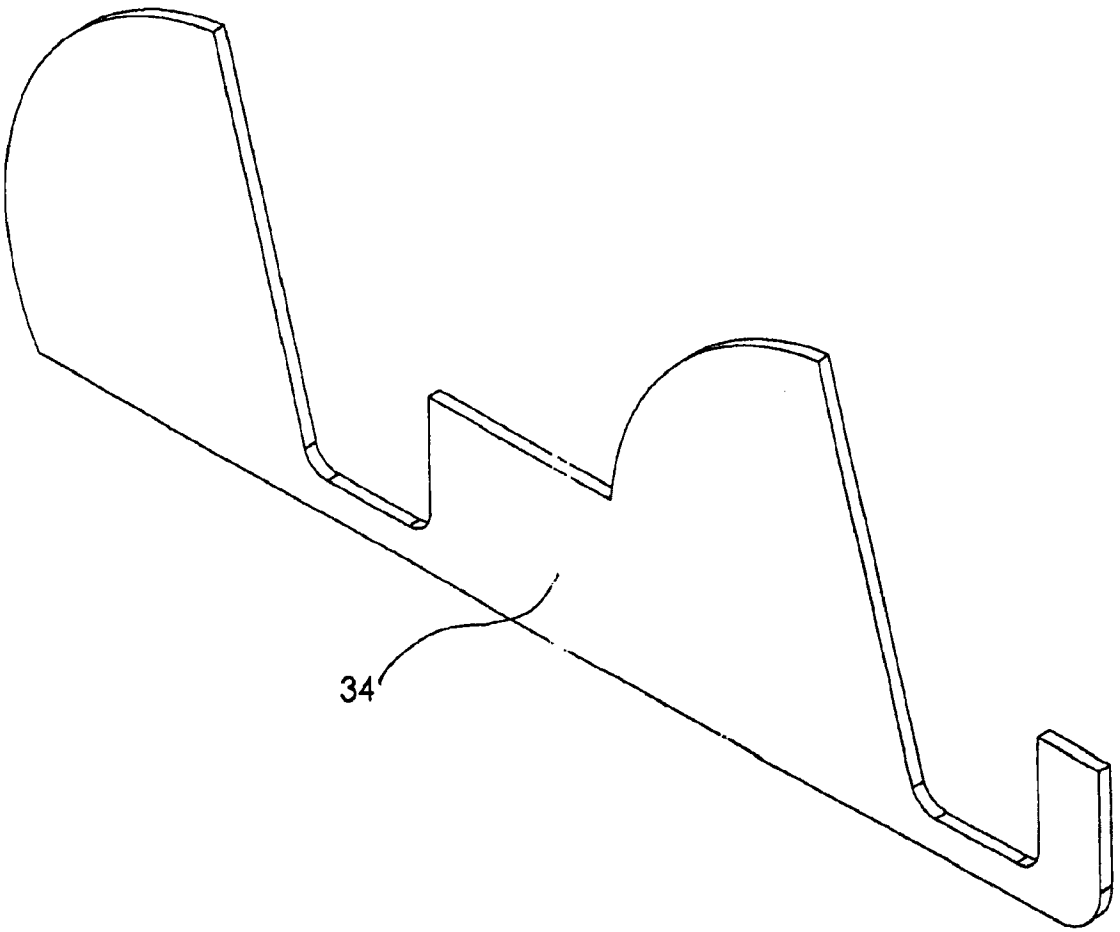
FIG. 13 is a perspective view of the side member of the example alternative horizontally oriented dispensing system embodiment.

A side view of an alternative embodiment of the present invention is illustrated in FIG. 9 with a side panel removed. As shown, the safety screen 21 and rotating cover 23 have the same axis of rotation 42. The axis of rotation 41 for the cylindrical part of the lower compartment is set off for ease of dispensing. The tabs 24 that add to the mass and balance of the rotating cover 23 are shown. In addition, the protective shroud 25 of the rotating cover 23 is illustrated as extending beyond the rotating cover 23. FIG. 10 is a perspective view of an aft or second tray member of the example alternative embodiment of the present invention. FIG. 11 is a perspective view of a first tray member 31 of the alternative embodiment of the present invention. The cover engages the tray coming to rest on stops 32. FIG. 12 is a perspective view of the cover member 23 of the alternative embodiment illustrating the tab or pin 24 for user contact to effect cover member 23 rotation and FIG. 13 is a perspective view of the side member 34 of the alternative embodiment.

Figure 14:
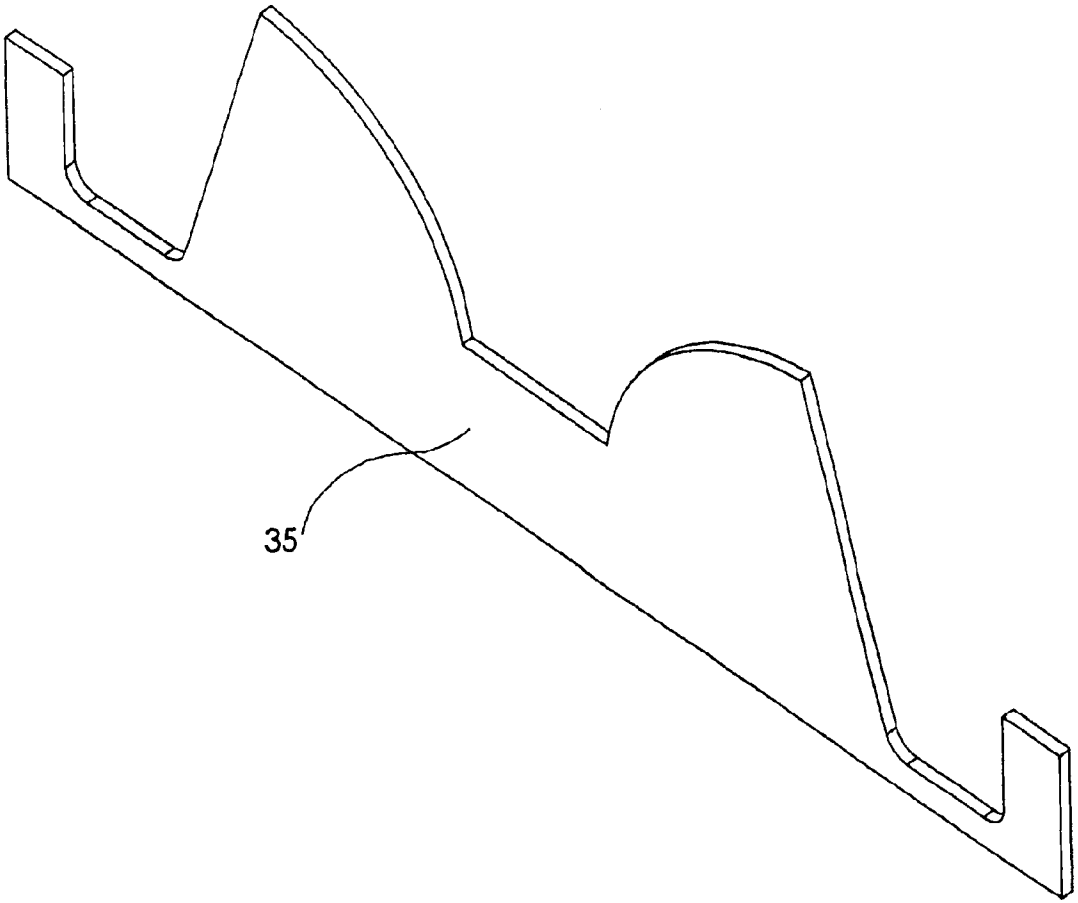
FIG. 14 is a perspective view of the side member of a third example embodiment of the invention.

In some applications, it is preferred to dispense material in two opposing directions. FIG. 14 is a perspective view of a side panel of a third alternative embodiment 35 where each dispensing assembly outwardly opposes one another and all other portions of the assemblies and the example dispensing system remains substantially the same as those described in detail above.

Method of Use

The preferred method of use comprises the major steps of loading the rolled material into the assembly and extracting and tearing off the rolled material.

The following procedure for loading the rolled material into the assembly wherein the present procedure is substantially the same for any kind of practicable material provided on similar rolls comprises the user executing the steps of:

1. Unrolling approximately 6" (approx. 14.5 cm) of material or a length anticipated appropriate for use;
2. Opening the cover;
3. Placing the roll on the shelf of lower compartment oriented so that sides of the roll fit between the sidewalls of the frame and so that the roll unwinds towards the back wall of the dispenser;
4. Holding the end of the unrolled portion with one hand where preferably the other hand of the user slightly pushes the roll towards the back wall of the frame whereby the roll will drop into the bed of the lower compartment;
5. Holding the unwound part of the material up and closing the cover; and
6. Tearing of the unrolled portion of the material with the other hand by pulling it up against the serrated blade with one hand while slightly pushing down the leverage pin with one hand.

The following procedure for extracting and tearing off the rolled material comprises the user executing the steps of:

1. Opening the cover;
2. Placing the index fingers of both hands under the slots on flat area of the lower compartment;
3. Grasping the portion of the material remaining on the flat area (after loading or previous dispensing) with two fingers from each side and pull upwards, where the material will unwind from the roll and where the roll will remain in the lower compartment;
4. Holding the extracted material of desired length up with one hand and closing the cover with the other hand; and
5. Tearing off the unrolled portion of the material by pulling with the user's first hand an applying tension so that the material lays against the serrated blade while slightly pushing down the leverage pin with the second hand of the user.

Many alterations and modifications may be made by those having ordinary skill in the art without departing from the spirit and scope of the invention. The words used in this specification to describe the invention in its several embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself. The definitions of the words or elements of the following claims are, therefore, defined in this specification to include not only the combination of elements which are literally set forth, but all equivalent structure, material or acts for performing substantially the same function in substantially the same way to obtain substantially the same result. In addition to the equivalents of the claimed elements, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the invention. Therefore, it must be understood that the illustrated preferred and alternative embodiments have been set forth only for the purposes of example and that it should not be taken as limiting the invention as defined by the following claims.

I claim:

1. A dispensing system comprising:

a first dispenser, wherein the first dispenser comprises:

a first tray having an arcuate section for receiving a roll of sheet material;

a first cover, having a front edge and a back edge, with an offset pivot point above a principal rotational axis of the first tray wherein a first cutting surface is fixedly attached to the front edge and the first cover is operably mounted within a first stationary cover wherein the first cover further comprises a first tab extension and the first stationary cover further comprises a slot for receiving the first tab extension, and wherein a rotation of the first cover is limited by the first tray.

2. The dispensing system of claim 1 wherein the first tray further comprises apertures for digitally contacting received sheet material.

3. The dispensing system of claim 1 further comprising:

a second dispenser wherein the second dispenser comprises:

a second tray having an arcuate section for receiving a roll of sheet material;

a second cover, having a front edge and a back edge, with an offset pivot point above a principal rotational axis of the second tray wherein a second cutting surface is fixedly attached to the front edge and the second cover is operably mounted within a second stationary cover.

4. The dispensing system of claim 3 wherein the second tray further comprises apertures for digitally contacting received sheet material.

5. The dispensing system of claim 3 wherein the second cover further comprises a second tab extension and the second stationary cover further comprises a slot for receiving the second tab extension, wherein a rotation of the second cover is limited by the second tray.

6. The dispensing system of claim 5 wherein the first dispenser and the second dispenser are mounted in a plane having a substantially horizontal orientation.

* * * * *